US010962190B2

(12) United States Patent
Matsuda et al.

(10) Patent No.: US 10,962,190 B2
(45) Date of Patent: Mar. 30, 2021

(54) LIGHTING DEVICE AND VEHICULAR HEADLAMP

(71) Applicant: Panasonic Intellectual Property Management Co., Ltd., Osaka (JP)

(72) Inventors: Takashi Matsuda, Hyogo (JP); Masahiro Kasano, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 198 days.

(21) Appl. No.: 16/309,110

(22) PCT Filed: Apr. 4, 2017

(86) PCT No.: PCT/JP2017/014057
§ 371 (c)(1),
(2) Date: Dec. 11, 2018

(87) PCT Pub. No.: WO2018/012058
PCT Pub. Date: Jan. 18, 2018

(65) Prior Publication Data

US 2019/0170315 A1 Jun. 6, 2019

(30) Foreign Application Priority Data

Jul. 15, 2016 (JP) ..... JP2016-139849

(51) Int. Cl.
*F21V 5/00* (2018.01)
*F21S 41/275* (2018.01)
(Continued)

(52) U.S. Cl.
CPC ..... *F21S 41/275* (2018.01); *F21S 41/24* (2018.01); *F21S 41/255* (2018.01); *F21S 41/26* (2018.01);
(Continued)

(58) Field of Classification Search
CPC ..... F21S 41/25; F21S 41/151; F21S 41/24; F21S 41/322; F21S 41/265; B60Q 1/04; F21V 2200/00; F21W 2102/00
See application file for complete search history.

(56) References Cited

U.S. PATENT DOCUMENTS

2004/0042212 A1 3/2004 Du et al.
2010/0226142 A1 9/2010 Brendle et al.
(Continued)

FOREIGN PATENT DOCUMENTS

JP 2005-537665 12/2005
JP 2009-087897 4/2009
(Continued)

OTHER PUBLICATIONS

Extended European Search Report dated Jul. 22, 2019 in related European Patent Application No. 17827192.0.
(Continued)

*Primary Examiner* — William J Carter
*Assistant Examiner* — Omar Rojas Cadima
(74) *Attorney, Agent, or Firm* — Wenderoth, Lind & Ponack, L.L.P.

(57) ABSTRACT

A lighting device includes a light emitting element; a first lens that captures and emits light generated by the light emitting element; and a second lens that captures light emitted from the first lens and emits the light in a predetermined direction. The first lens includes a first-lens-entrance through which the light generated by the light emitting element enters, a first lens exit that emits the light entered from the first-lens-entrance and transmitted through an inside of the first lens, and a plurality of first-lens-side-portion-wall-surfaces that are provided between the first-lens-entrance and the first lens exit. The plurality of first-lens-side-portion-wall-surfaces include a reflection-side-
(Continued)

surface-portion that reflects the light entered the inside of the first lens from the first-lens-entrance, and a side surface portion that is configured to allow light having a luminous intensity smaller than a luminous intensity of light entering the reflection-side-surface-portion to enter.

15 Claims, 16 Drawing Sheets

(51) Int. Cl.

| | |
|---|---|
| ***F21S 41/255*** | (2018.01) |
| ***F21S 41/27*** | (2018.01) |
| ***F21S 41/32*** | (2018.01) |
| ***F21S 41/24*** | (2018.01) |
| ***F21S 41/26*** | (2018.01) |
| ***F21S 41/43*** | (2018.01) |
| ***F21S 41/20*** | (2018.01) |
| *F21W 102/13* | (2018.01) |

(52) U.S. Cl.

CPC ..... *F21S 41/27* (2018.01); *F21S 41/285* (2018.01); *F21S 41/322* (2018.01); *F21S 41/43* (2018.01); *F21V 5/008* (2013.01); *F21W 2102/13* (2018.01)

(56) References Cited

U.S. PATENT DOCUMENTS

| | | | | |
|---|---|---|---|---|
| 2012/0057363 | A1 | 3/2012 | Ishida et al. | |
| 2014/0003071 | A1 | 1/2014 | de Lamberterie et al. | |
| 2014/0362596 | A1 | 12/2014 | Nakaya | |
| 2015/0036373 | A1 | 2/2015 | Chen | |
| 2016/0040848 | A1 * | 2/2016 | Tsukamoto ..... | F21S 41/68 362/509 |
| 2016/0146417 | A1 | 5/2016 | Ohsawa et al. | |
| 2016/0341386 | A1 | 11/2016 | Iha et al. | |
| 2017/0122528 | A1 | 5/2017 | Kadoriku et al. | |

FOREIGN PATENT DOCUMENTS

| | | | |
|---|---|---|---|
| JP | 2012-059409 | 3/2012 | |
| JP | 2014-241220 | 12/2014 | |
| JP | 2015-111499 | 6/2015 | |
| JP | 2016-039110 | 3/2016 | |
| WO | 2015/040671 | 3/2015 | |
| WO | 2015/107678 | 7/2015 | |
| WO | 2015/198527 | 12/2015 | |
| WO | WO-2015198527 A1 * | 12/2015 | ..... F21S 41/24 |

OTHER PUBLICATIONS

International Search Report of PCT application No. PCT/JP2017/014057 dated Jun. 20, 2017.

* cited by examiner

| EMBODIMENT | UNIT PEAK LUMINOUS INTENSITY (cd) | COMBINED LUMINOUS INTENSITY (cd) | LIGHT FLUX OF LIGHT SOURCE (lm) |
|---|---|---|---|
| 1 | 24000 | 32800 | 400 |
| 2 | 5800 | 8800 | 400 |
| 3 | 3000 | 3000 | 600 |

LIGHTING DEVICE AND VEHICULAR HEADLAMP

CROSS-REFERENCE TO RELATED APPLICATIONS

This application is a U.S. national stage application of the PCT International Application No. PCT/JP2017/014057 filed on Apr. 4, 2017, which claims the benefit of foreign priority of Japanese patent application 2016-139849 filed on Jul. 15, 2016, the contents all of which are incorporated herein by reference.

TECHNICAL FIELD

The present disclosure relates to a lighting device and a vehicular headlamp using the lighting device.

BACKGROUND ART

As a vehicular headlamp (so-called headlight), for example, a lighting device described in PTL 1 is used. FIG. 15 is a sectional view of lighting device 100 described in PTL 1. Lighting device 100 is configured of light emitting diode (LED) 101, board 102, reflecting plate 103, and opening 104. Light diverging from LED 101 is reflected by reflecting plate 103 and is applied in a predetermined direction through opening 104.

Here, since most of light diverged from LED 101 is reflected by reflecting plate 103 and is applied in the predetermined direction, a luminous intensity gradient of light distribution of lighting device 100 is steep and a boundary between light and dark is conspicuous. Therefore, when a plurality of lighting devices 100 are provided, there is a problem that a luminous intensity gradient of combined light distribution is steep and streak unevenness occurs in the light distribution. Here, the streak unevenness refers to a bright light or a dark line generated between the light distributions of the plurality of lighting devices, for example, when a road surface is irradiated. Such streak unevenness occurs, so that an unnatural pattern appears on a road surface and visibility of a driver is deteriorated.

CITATION LIST

Patent Literature

PTL 1: Japanese Patent Unexamined Publication No. 2005-537665

SUMMARY OF THE INVENTION

In order to solve the problem described above, according to the disclosure, there is provided a lighting device including: a light emitting element; a first lens that captures and emits light generated by the light emitting element; and a second lens that captures light emitted from the first lens and emits the light in a predetermined direction. The first lens includes a first lens entrance through which the light generated by the light emitting element enters, a first lens exit that emits the light entered from the first lens entrance and transmitted through an inside of the first lens, and a plurality of first lens side portion wall surfaces that are provided between the first lens entrance and the first lens exit. The plurality of first lens side portion wall surfaces include a reflection side surface portion that reflects the light entered the inside of the first lens from the first lens entrance, and a side surface portion that is configured to allow light having a luminous intensity smaller than a luminous intensity of light entering the reflection side surface portion to enter.

According to the lighting device of the disclosure, the plurality of first lens side portion wall surfaces of the first lens include the side surface portion configured to allow the light having the luminous intensity smaller than the luminous intensity of the light entering the reflection side surface portion to enter. Therefore, a part of a boundary between light and dark of the light distribution of the lighting device is blurred and inconspicuous. The boundary between light and dark is inconspicuous so that a luminous intensity gradient of combined light distribution when the light distributions of a plurality of lighting devices overlap each other is gentle, streak unevenness does not occur, and visibility of an irradiation target can be improved.

DESCRIPTION OF EMBODIMENTS

Embodiment 1

Figure 1A:
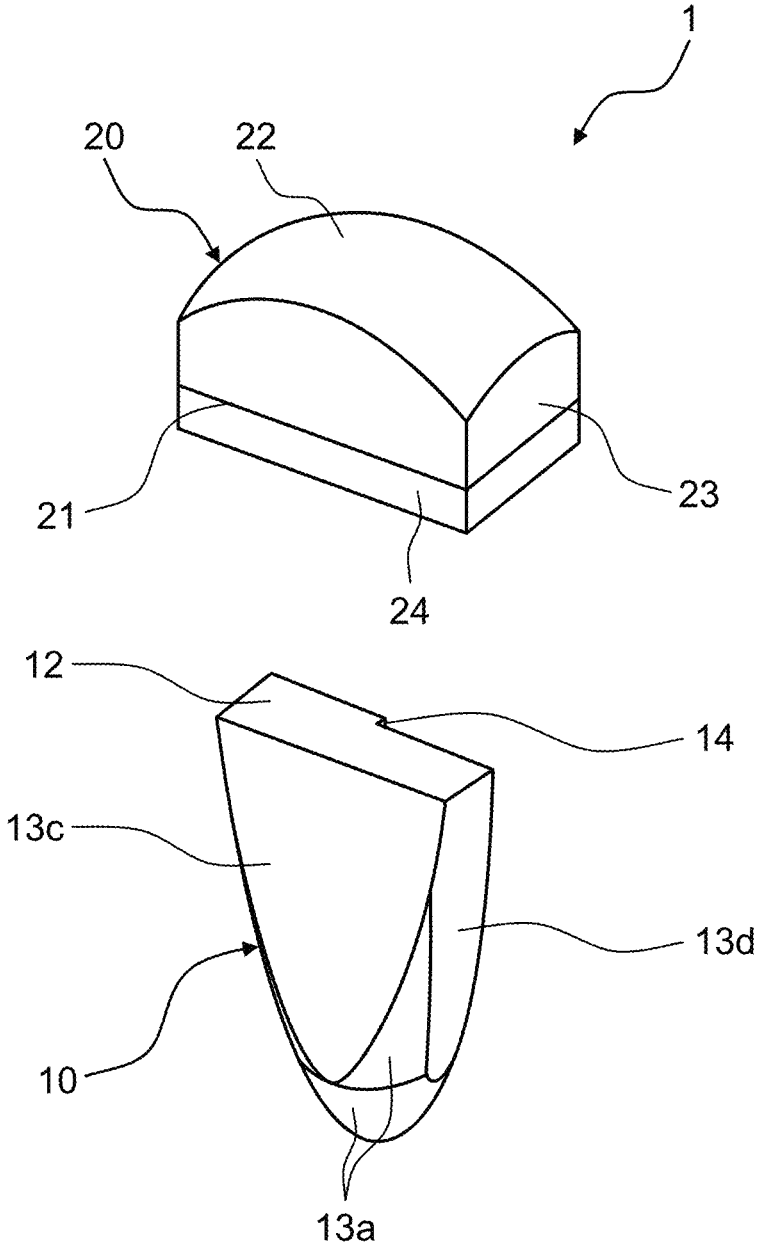
FIG. 1A is a perspective view of a lighting device according to Embodiment 1.
Figure 1B:
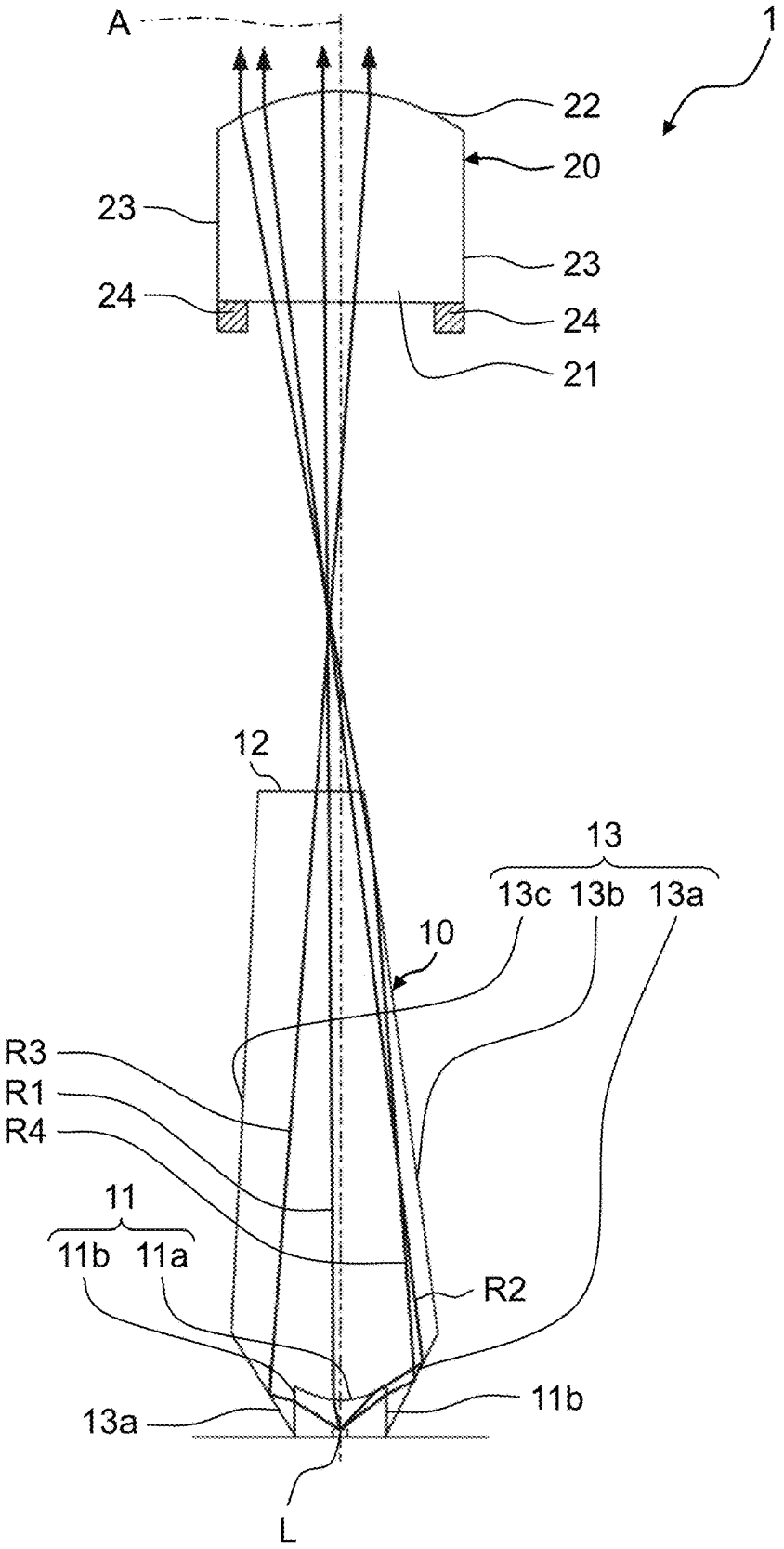
FIG. 1B is a view illustrating a structure and an optical path of the lighting device according to Embodiment 1.

A lighting device according to Embodiment 1 will be described with reference to FIGS. 1A to 4. Lighting device 1 according to the embodiment configures, for example, a part of a headlamp (so-called low beam) for passing by a vehicular headlamp. FIG. 1A is a perspective view of an entirety of lighting device 1 and FIG. 1B is a view illustrating a structure and an optical path of lighting device 1. Lighting device 1 includes first lens 10, second lens 20, and light emitting element L (see FIG. 1B). Moreover, a horizontal line at a lower end of the page of FIG. 1B indicates a board. In FIG. 1B, a right side of the page indicates a lower side of a vehicle, a left side thereof indicates an upper side of the vehicle, an upper side of the page indicates a front side of the vehicle, and a lower side of the page indicates a back side of the vehicle, respectively.

Light emitting element L generates and emits light, and is, for example, a light emitting diode (LED). First lens 10 is configured to capture, collect, and emit the light generated from light emitting element L. Second lens 20 is configured to capture the light emitted from first lens 10 and form desired light distribution by emitting the light in a predetermined direction. Materials of first lens 10 and second lens 20 may be inorganic glass or organic plastic typified by acrylic and polycarbonate. Hereinafter, a specific aspect of each configuration will be described below.

First lens 10 includes first lens entrance 11 where the light generated by light emitting element L enters, first lens exit 12 from which the light being entered from first lens entrance 11 and passing through an inside of first lens 10 emits, and a plurality of first lens side portion wall surfaces 13 provided between first lens entrance 11 and first lens exit 12. Specifically, first lens entrance 11 has a recessed shape surrounding a periphery of light emitting element L and is configured of first entrance surface 11*a* that is a recessed bottom surface and second entrance surface 11*b* that is a recessed side surface. Light beams generated from light emitting element L enter first lens 10 through one of first entrance surface 11*a* and second entrance surface 11*b* of first lens entrance 11 of first lens 10.

A plurality of first lens side portion wall surfaces 13 include first reflection surface 13*a*, second reflection surface 13*b*, and side surface portion 13*c*. First reflection surface 13*a* reflects the light entered from second entrance surface 11*b*. Second reflection surface 13*b* reflects the light entered from first entrance surface 11*a* and the light reflected by first reflection surface 13*a*. Side surface portion 13*c* is provided at a position where most of the light entered first entrance surface 11*a* and the light reflected by first reflection surface 13*a* do not reach.

As a specific configuration, first reflection surface 13*a* is configured such that one end is connected to first lens entrance 11 and the other end is connected to second reflection surface 13*b* or side surface portion 13*c*. Second reflection surface 13*b* and side surface portion 13*c* are configured such that one ends are connected to first reflection surface 13*a* and the other ends are connected to first lens exit 12. Second reflection surface 13*b* is provided on first lens side portion wall surface 13 on a lower side of first lens 10 and side surface portion 13*c* is provided on first lens side portion wall surface 13 on an upper side of first lens 10.

Arrows R1 to R4 indicate examples of the light beams generated by light emitting element L and collected on first lens exit 12 of the first lens. Light beam R1 directly reaches first lens exit 12 through first entrance surface 11*a*. Light beam R2 passes through first entrance surface 11*a*, is reflected by second reflection surface 13*b*, and is guided to first lens exit 12. Light beam R3 enters second entrance surface 11*b* and then is reflected by first reflection surface 13*a*, and is guided to first lens exit 12. Light beam R4 enters second entrance surface 11*b*, is reflected by first reflection surface 13*a* and then is further reflected by second reflection surface 13*b*, and is guided to first lens exit 12.

Here, first lens side portion wall surface 13 of lighting device 1 according to the embodiment is configured so that most of the light beams entered the inside of first lens 10 do not reach side surface portion 13*c*. Specifically, side surface portion 13*c* is a surface where light having luminous intensity smaller than luminous intensity of the light entering first reflection surface 13*a* and second reflection surface 13*b* (hereinafter, first reflection surface 13*a* and second reflection surface 13*b* are collectively referred to as reflection side surface portions) enters. That is, the number of the light beams entering side surface portion 13*c* is smaller than the number of the light beams entering the reflection side surface portion. Moreover, side surface portion 13*c* may be a surface capable of reflecting the light, may be a surface capable of absorbing the light, or may be a surface capable of transmitting the light.

As described above, as a method for controlling the light beams, for example, there is a method in which a shape of first entrance surface 11*a* is formed in a projection shape toward light emitting element L and the light entering first reflection surface 13*a* is refracted toward horizontal line A passing through a center of light emitting element L. In addition, it is also conceivable to provide a method in which an angle of first reflection surface 13*a* is adjusted so that most of light beams do not reach side surface portion 13*c*. Otherwise, it is also conceivable to provide a method in which side surface portion 13*c* is made substantially parallel to horizontal line A passing through the center of light emitting element L, or side surface portion 13*c* is formed so as to be away from horizontal line A as going from a first lens entrance 11 side to a first lens exit 12 side (that is, as going to the front side of the vehicle). However, as long as there is a range where the light beams do not reach, side surface portion 13*c* may be formed so as to approach horizontal line A as going from first lens entrance 11 to first lens exit 12 side.

Second lens 20 is disposed on the front side of the vehicle from first lens 10. Second lens 20 includes second lens entrance 21 having a flat shape where the light emitted from first lens exit 12 of first lens 10 enters, second lens exit 22 of the projection shape from which the light being entered from second lens entrance 21 and passing through an inside of second lens 20 emits, and second lens side portion wall surface 23 provided between second lens entrance 21 and second lens exit 22. The light collected by first lens 10 is emitted through second lens entrance 21 having the flat shape and second lens exit 22 having the projection shape in a predetermined direction. Second lens exit 22 has the projection shape toward a side (front side of the vehicle) opposite to light emitting element L, so that the light emitted from second lens exit 22 becomes substantially parallel light.

In addition, light shielding member 24 for shielding the light entering second lens side portion wall surface 23 through second lens entrance 21 is provided at an outer edge of second lens entrance 21. Therefore, it is possible to prevent light unnecessary for light distribution formation from being totally reflected by second lens side portion wall surface 23 of second lens 20 and to reduce glare of the headlight light. In addition, an uneven structure (illustration is omitted) is formed on second lens side portion wall surface 23 of second lens 20 and unnecessary light entering second lens side portion wall surface 23 is diffused, so that it is possible to reduce the glare of the headlight light. A depth size of the uneven structure may be tens microns or several millimeters. The uneven structure may be a spherical shape, a semi-cylindrical shape, or a quadrangular pyramid shape, and is not particularly limited as long as the uneven structure has a shape capable of diffusing the light.

Figure 2A:
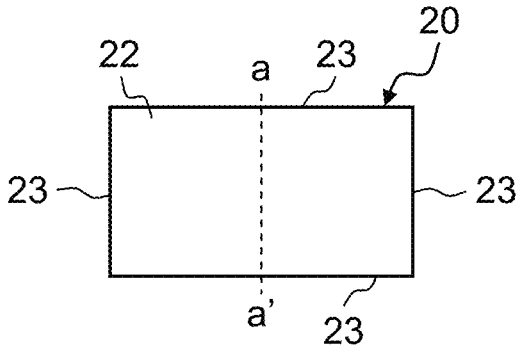
FIG. 2A is a front view of a second lens of the lighting device according to Embodiment 1.
Figure 2B:
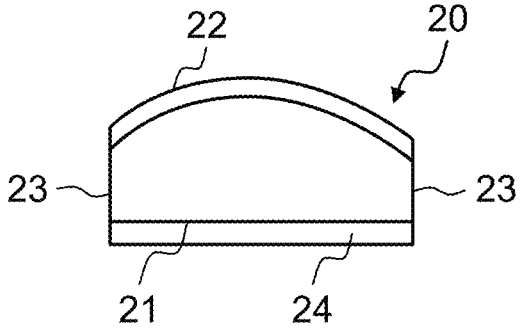
FIG. 2B is a plan view of the second lens of the lighting device according to Embodiment 1.
Figure 3A:
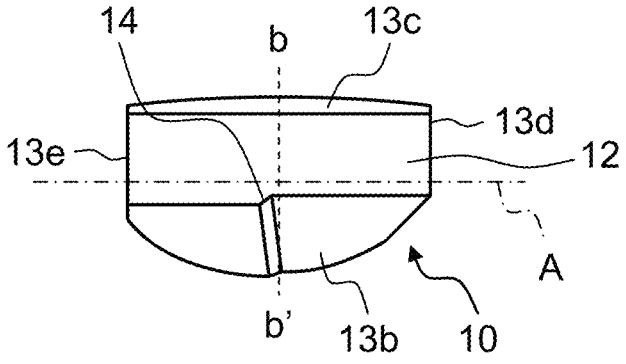
FIG. 3A is a front view of a first lens of the lighting device according to Embodiment 1.
Figure 3B:
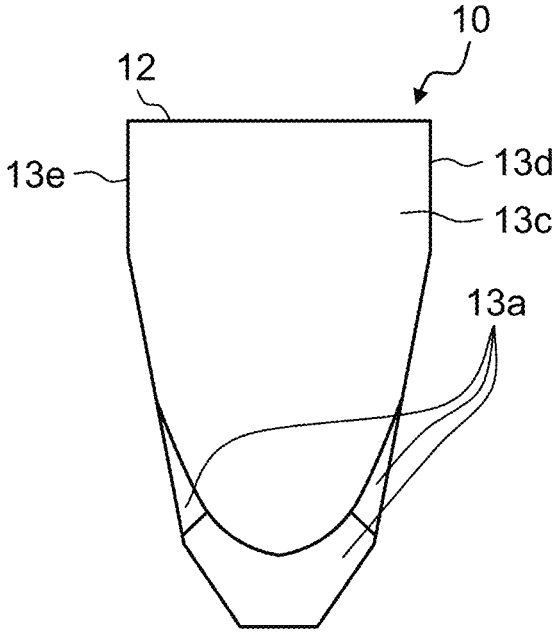
FIG. 3B is a plan view of the first lens of the lighting device according to Embodiment 1.

FIG. 2A is a front view of second lens 20. FIG. 2B is a plan view of second lens 20. FIG. 3A is a front view of first lens 10. FIG. 3B is a plan view of first lens 10. In FIGS. 2A and 3A, a front side of the page is the front side of the vehicle and a depth side of the page is the back side of the vehicle. In addition, FIGS. 2B and 3B, an upper side of the page is the front side of the vehicle and a lower side of the page is the back side of the vehicle. FIG. 1B illustrates first lens 10 and second lens 20 in section a-a' of FIG. 2A and section b-b' of FIG. 3A.

A shape of first lens exit 12 of first lens 10 is designed to correspond to a light distribution shape desired to be projected, and here, step 14 (see FIGS. 1A and 3A) for a cutoff line which is required by a passing headlamp (so-called low beam) of the vehicular headlamp is formed. Here, the cutoff line indicates a portion where a boundary between light and dark is bent and the light distribution is partially cut out so as not to give dazzle to a driver of an oncoming vehicle. Step 14 is provided only on second reflection surface 13*b*.

Side surface portion 13*d* and side surface portion 13*e* in FIG. 3A are side surface portions where most of the light beams entered first lens 10 do not reach like side surface portion 13*c*. That is, in first lens 10, the light reaches only second reflection surface 13*b* in which step 14 is provided and most of the light beams do not reach other side surface portions 13*c*, 13*d*, and 13*e* of first lens side portion wall surface 13.

Figure 4:
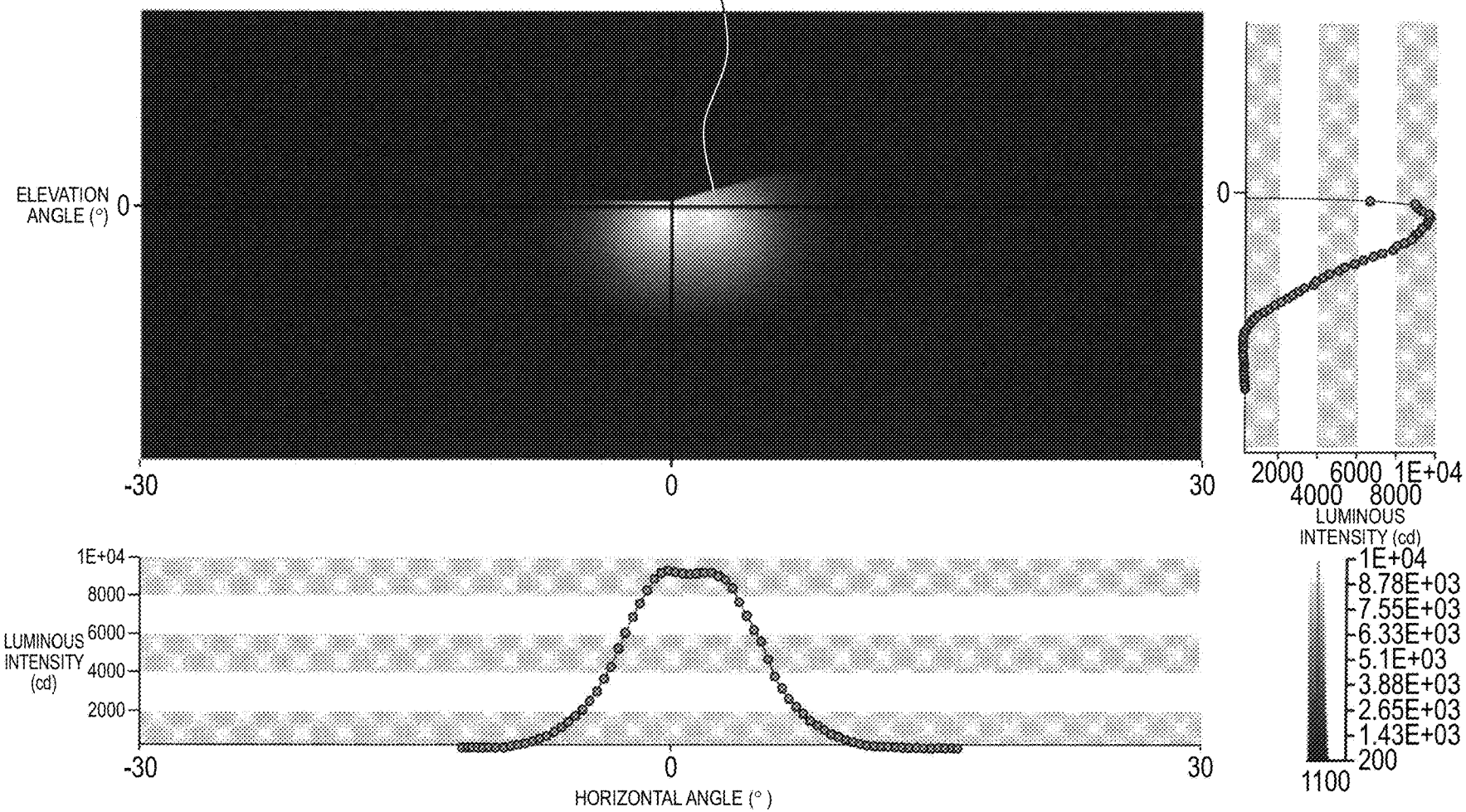
FIG. 4 is a view illustrating luminous intensity distribution in a horizontal direction and a height direction of the lighting device according to Embodiment 1.

FIG. 4 is a view of the light distribution when the light is projected using lighting device 1 (see FIG. 1A or 1B) according to the embodiment and is a view of a distribution of the luminous intensity in a horizontal direction and a height direction. Hereinafter, an angle in the horizontal direction is referred to as a horizontal angle and an angle in the height direction is referred to as an elevation angle. A portion with high luminous intensity is illustrated in white and a portion with low luminous intensity is illustrated in black. In an upper portion of the view of the light distribution, cutoff line C1 is formed and the boundary between light and dark is conspicuous because the luminous intensity gradient is steep. On the other hand, in right and left portions, and a lower portion of the view of the light distribution, the boundary between light and dark are blurred and inconspicuous.

It can be seen from the view of the luminous intensity distribution in the horizontal direction that the luminous intensity gently changes in the horizontal direction. The luminous intensity gently changes, so that the boundary of the light distribution is inconspicuous. In addition, it can be seen from the view of the luminous intensity distribution in the height direction that the luminous intensity gently changes in the lower portion in the height direction, but the luminous intensity steeply changes in the upper portion in the height direction.

As described above, in a case where first lens side portion wall surface 13 of first lens 10 is second reflection surface 13*b*, the boundary of the light distribution of the light reflected by the surface is conspicuous, whereas in a case where first lens side portion wall surface 13 is side surface portion 13*c*, 13*d*, or 13*e* where most of light entered first lens 10 does not reach, the boundary of the light distribution of the light is inconspicuous because most of the light is not reflected by the surface. For example, side surface portion 13*c* emits the light that is going to be emitted to the outside of side surface portion 13*c* as it is. On the other hand, second reflection surface 13*b* reflects the light that is going to be emitted to the outside of second reflection surface 13*b* and the light overlaps the light on the inside, so that a change in the luminous intensity is steep in the boundary.

Figure 5:
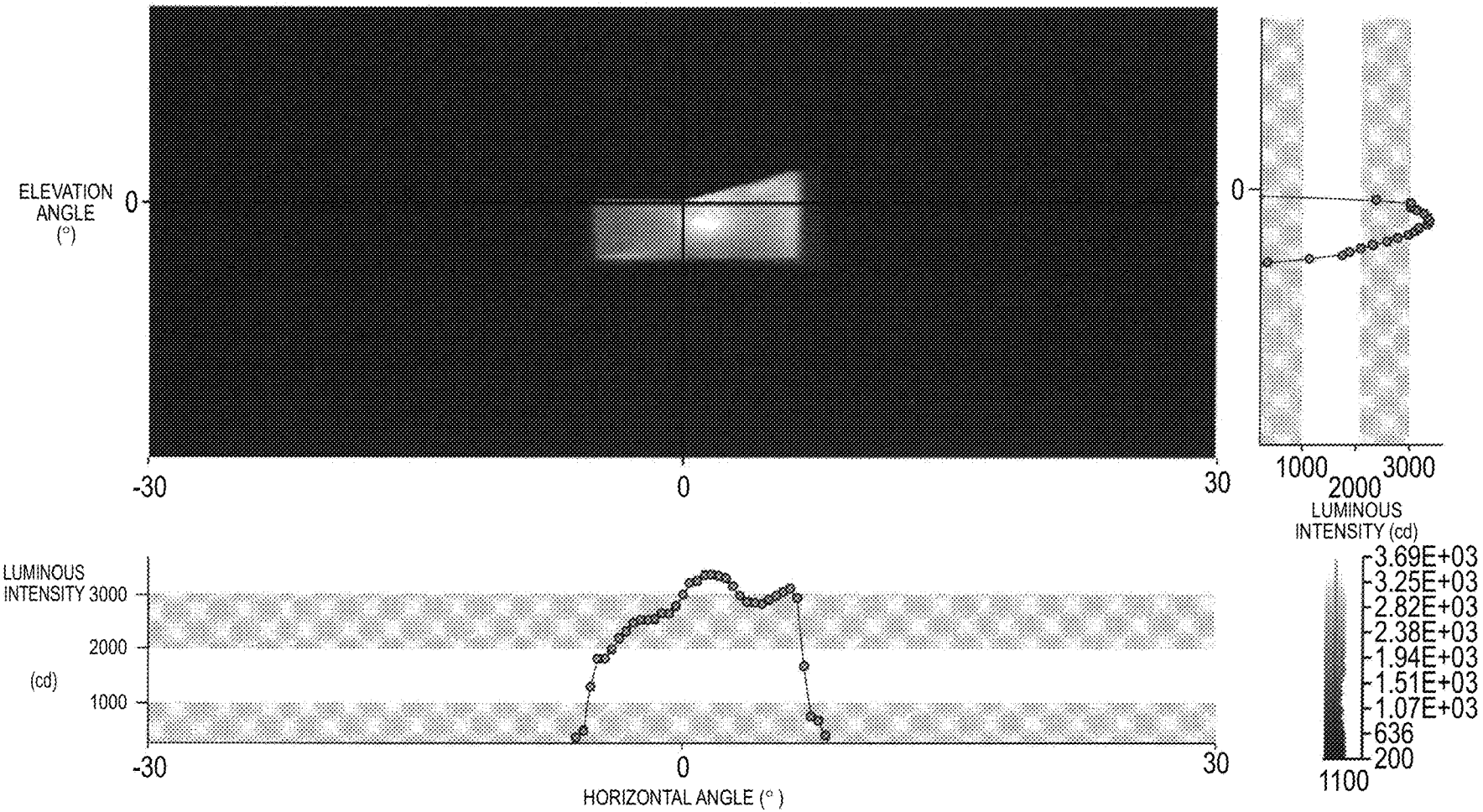
FIG. 5 Prior Art
FIG. 5 is a view illustrating luminous intensity distribution in a horizontal direction and a height direction of a lighting device of the related art.

FIG. 5 illustrates luminous intensity distribution in the horizontal direction and the height direction of a lighting device of the related art. In the lighting device of the related art, all side portion wall surfaces are reflection surfaces and as illustrated in FIG. 5, all boundaries are conspicuous with such a configuration. Therefore, the streak unevenness occurs and visibility of the irradiation target is lowered. In lighting device 1 according to the embodiment, as illustrated in FIG. 4, the advantage of the boundary being inconspicuous is that when the light beams of the plurality of lighting devices overlap each other, the luminous intensity gradient of the combined light distribution is gentle, the light distribution becomes natural light distribution without the streak unevenness, and visibility of the irradiation target is improved. On the other hand, it is preferable that the boundary (boundary of the upper portion of the light distribution) between light and dark of the cutoff line is conspicuous in the passing headlamp.

Furthermore, in the structure of the related art, the cutoff line is formed by shielding the light by a light shielding plate. In this case, the light absorbed by the light shielding plate is not effectively used and energy efficiency is deteriorated. In the structure of lighting device 1 according to the embodiment, cutoff line C1 is formed by reflecting the light by second reflection surface 13*b* of first lens 10, so that the light is not wasted and effectively utilized, and energy efficiency can be improved.

Embodiment 2

Figure 6:
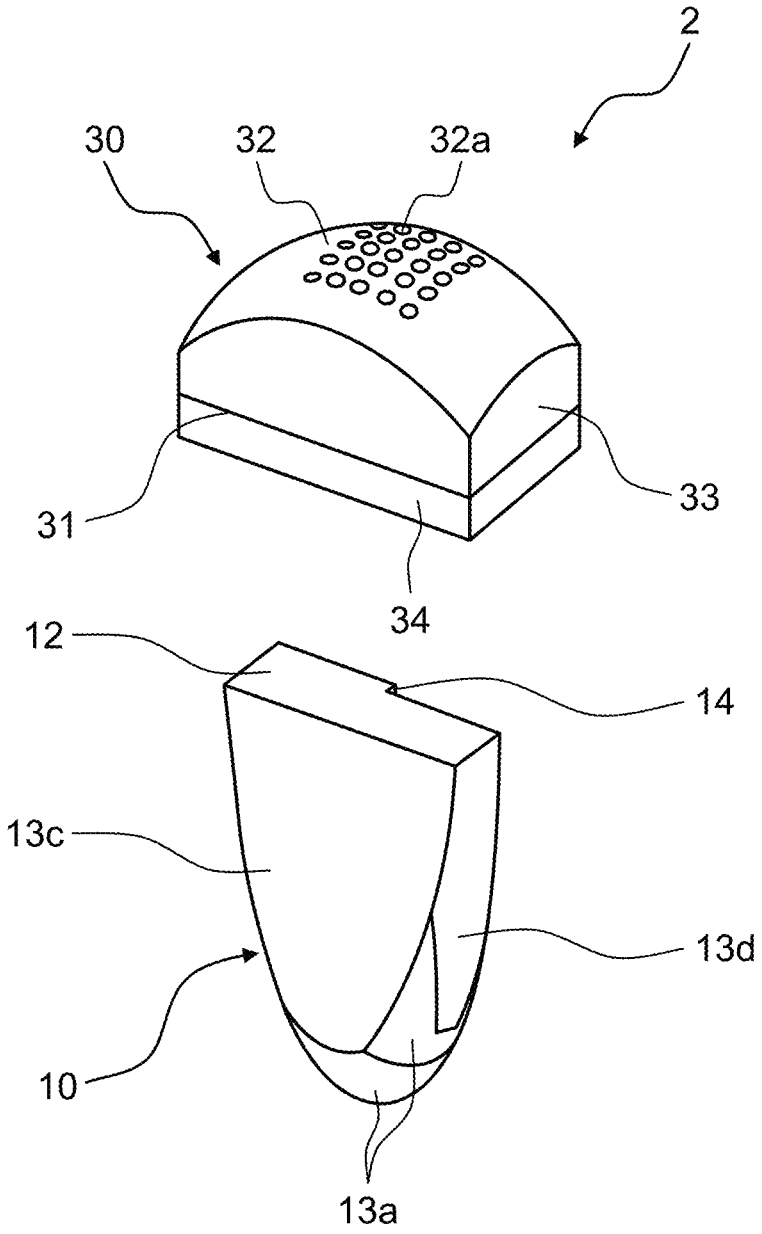
FIG. 6 is a perspective view of a lighting device according to Embodiment 2.
Figure 7A:
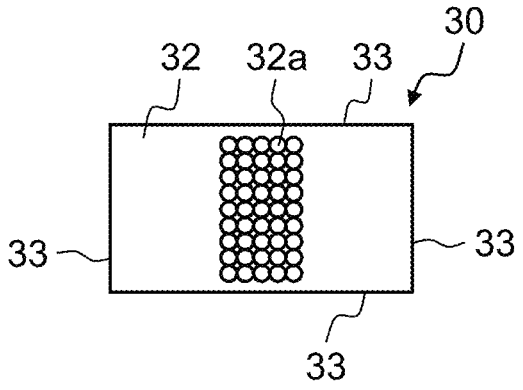
FIG. 7A is a front view of a second lens of the lighting device according to Embodiment 2.
Figure 7B:
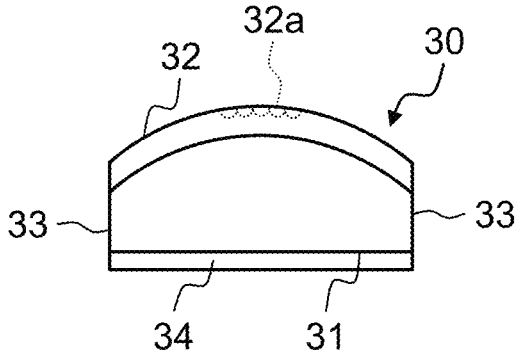
FIG. 7B is a plan view of the second lens of the lighting device according to Embodiment 2.
Figure 7C:
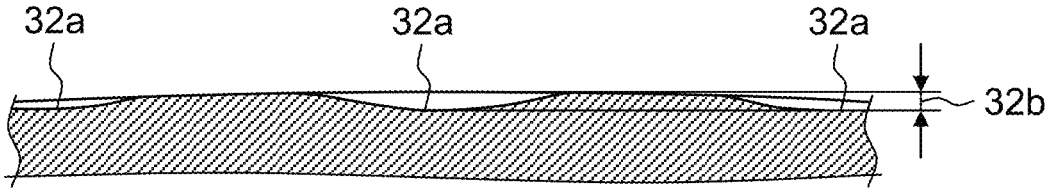
FIG. 7C is an enlarged sectional view of a second lens exit of the second lens of the lighting device according to Embodiment 2.

Next, a lighting device according to Embodiment 2 will be described with reference to FIGS. 6 to 7C. Since configurations of a first lens and a light emitting element are the same as those of Embodiment 1, detailed description will be omitted. FIG. 6 is a perspective view of lighting device 2 according to Embodiment 2. FIG. 7A is a front view of second lens 30 of lighting device 2. FIG. 7B is a plan view of second lens 30 of lighting device 2. In FIGS. 6 to 7B, reference numeral 31 indicates a second lens entrance, reference numeral 32 indicates a second lens exit, reference numeral 33 indicates a second lens side portion wall surface, and reference numeral 34 indicates a light shielding member, respectively.

A plurality of depressions 32*a* having a spherical shape are provided at a center (center of the vehicle in a width direction) on right and left sides of second lens exit 32 of second lens 30. For example, the plurality of depressions 32*a* are adjacent to each other in the width direction and the height direction of the vehicle. FIG. 7C is an enlarged sectional view of depressions 32*a*. Depression 32*a* has an effect of concentrically spreading and emitting a part of the light entered second lens entrance 31. In this case, spreading of the light distribution and the luminous intensity can be optionally adjusted by appropriately adjusting a curvature of the spherical shape and depth 32*b*. Hereinafter, the light distribution which is concentrically spread by depression 32*a* is referred to as overhead portion D21 (see FIG. 11A). Overhead portion D21 is useful, for example, for irradiating a guide plate or the like above a road surface during running of the vehicle.

It is preferable that the luminous intensity of overhead portion D21 is 10 candela or more and 625 candela or less. If it is less than 10 candela, the light is too weak and insufficient to apply the guide plate, whereas if it is larger than 625 candela, the light is too bright to give dazzle to a driver of an oncoming vehicle and a pedestrian.

Here, the light emitted from a portion of second lens exit 32, where depression 32*a* is not provided, forms the light distribution having the same shape as that of Embodiment 1. Hereinafter, the light distribution is referred to as body portion D22 (see FIG. 11A).

In lighting device 2 according to Embodiment 2, since depression 32*a* having the spherical shape is provided in second lens exit 32 of second lens 30, it is superior in that the light distribution of body portion D22 and the light distribution of overhead portion D21 can be formed at the same time with one lighting device 2.

Embodiment 3

Figure 8:
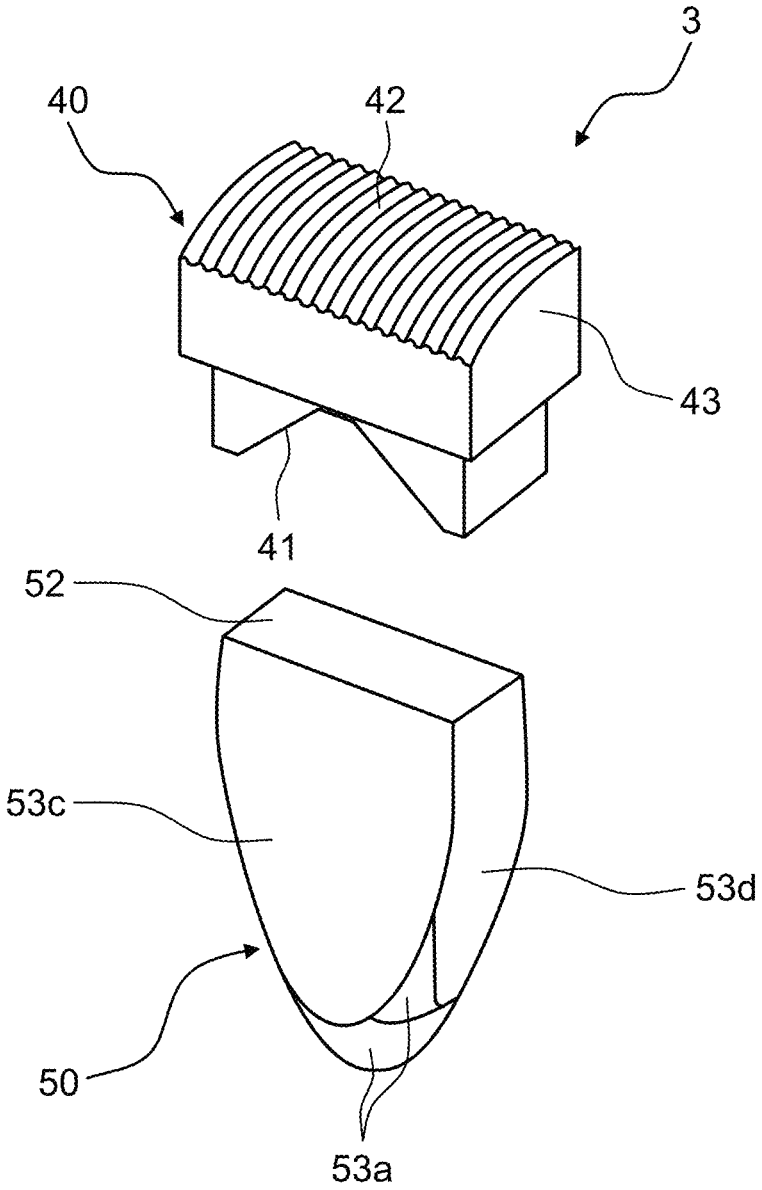
FIG. 8 is a perspective view of a lighting device according to Embodiment 3.
Figure 9A:
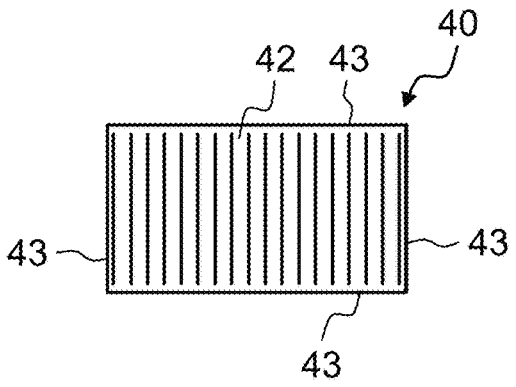
FIG. 9A is a front view of a second lens of the lighting device according to Embodiment 3.
Figure 9B:
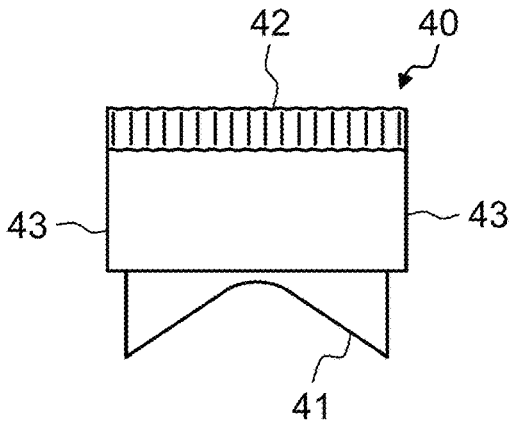
FIG. 9B is a plan view of the second lens of the lighting device according to Embodiment 3.

Next, a lighting device according to Embodiment 3 will be described. Detailed description of the same configuration as that of Embodiment 1 will be omitted and a configuration different from that of Embodiment 1 will be mainly described. FIG. 8 is a perspective view of lighting device 3 according to Embodiment 3. FIG. 9A is a front view of second lens 40 of lighting device 3. FIG. 9B is a plan view of second lens 40 of lighting device 3. In FIGS. 8 to 9B, reference numeral 41 indicates a second lens entrance, reference numeral 42 indicates a second lens exit, and reference numeral 43 indicates a second lens side portion wall surface, respectively.

Figure 9C:
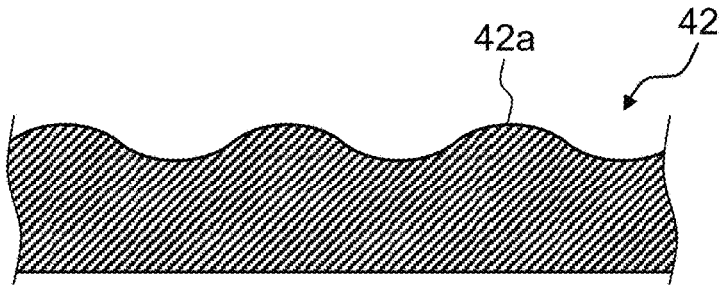
FIG. 9C is an enlarged sectional view of a second lens exit of the second lens of the lighting device according to Embodiment 3.

As illustrated in FIG. 9B, second lens entrance 41 of second lens 40 has a shape (recessed shape) in which a center of the vehicle in the width direction is recessed. In addition, unevenness (periodic structure) having a wave shape in the horizontal direction is provided on an entire surface of second lens exit 42 of second lens 40. FIG. 9C is an enlarged sectional view of a bottom surface of second lens exit 42 of second lens 40. The light distribution of the light emitted from second lens 40 is spread in the horizontal direction by the structure.

Figure 10A:
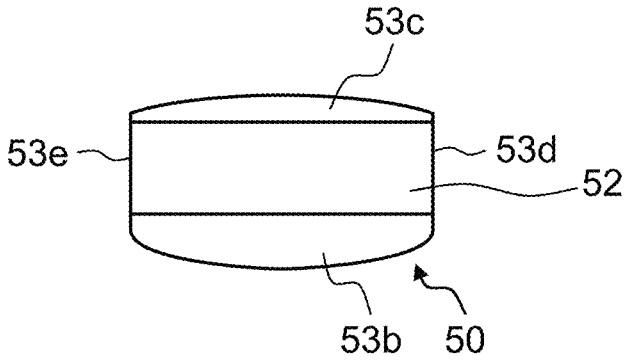
FIG. 10A is a front view of a first lens of the lighting device according to Embodiment 3.
Figure 10B:
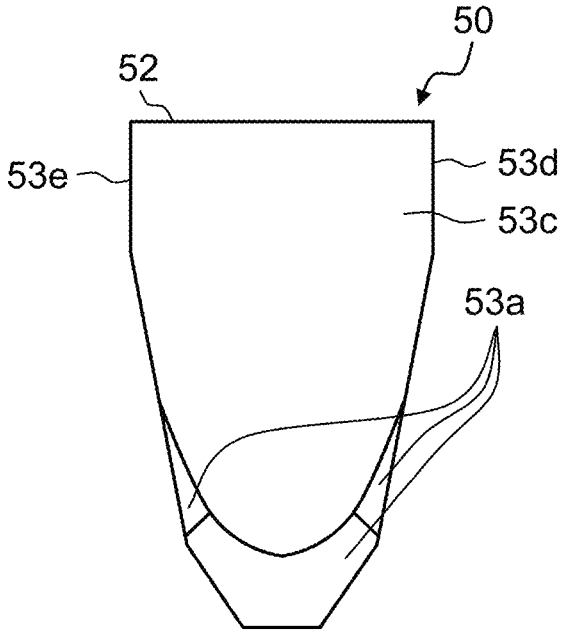
FIG. 10B is a plan view of the first lens of the lighting device according to Embodiment 3.

FIG. 10A is a front view of first lens 50 of lighting device 3 (see FIG. 8) according to Embodiment 3. FIG. 10B is a plan view of first lens 50 of the lighting device 3. First lens 50 is different from the first lens according to Embodiment 1 in that the step for the cutoff line is not provided. In FIGS. 10A and 10B, reference numeral 52 indicates a first lens exit, reference numerals 53*a* and 53*b* indicate reflection surfaces (reflection side surface portions according to the disclosure), reference numerals 53*c*, 53*d*, and 53*e* indicate side surface portions where most of the light entered first lens 50 does not reach, respectively.

According to lighting device 3 of Embodiment 3, visibility on both right and left sides as viewed from the driver of the vehicle can be improved. Hereinafter, details will be described below. For example, in the lighting device according to Embodiment 1 or 2, since the luminous intensity in the front of the vehicle is strong, it is suitable for irradiating the front far away, while a range of the light distribution in the horizontal direction is narrow, so that pedestrians and the like on the right and left sides as viewed from the driver of the vehicle appear dark, light and dark of the boundary of the light distribution occur, and visibility is lowered. Lighting device 3 according to Embodiment 3 is weaker in the luminous intensity in the front of the vehicle than those in Embodiments 1 and 2, but the range of the light distribution in the horizontal direction is wide, so that the visibility on the both right and left sides as viewed from the driver of the vehicle can be improved.

In addition, lighting device 3 according to Embodiment 3 is suitable for irradiating slightly below the cutoff line. Therefore, in the embodiment, the step for the cutoff line is not provided in first lens 50. However, the step for the cutoff line may be provided.

In this case, it is preferable that the range of the light distribution is wider than a range of −30° to +30° in the horizontal direction and wider than a range of −10° to 0° in the height direction. In a case where the range of the light distribution is wider than the range of −30° to +30° in the horizontal direction and wider than the range of −10° to 0° in the height direction, it is sufficient to improve the visibility on the right and left as viewed from the driver of the vehicle.

Embodiment 4

Lighting device 4 (see FIG. 11C) according to Embodiment 4 is vehicular headlamp 120 (see FIG. 11C) configured by combining lighting devices 1 to 3 according to Embodiments 1 to 3.

Figure 11A:
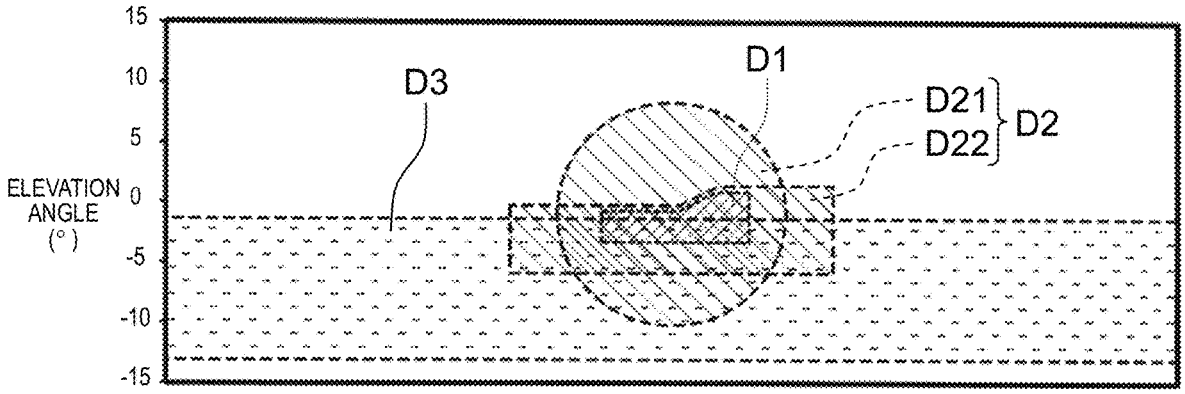
FIG. 11A is a view illustrating respective light distributions of the lighting device according to Embodiment 1, the lighting device according to Embodiment 2, and the lighting device according to Embodiment 3, and combined light distribution obtained by overlapping the respective light distributions, in a vehicle headlamp according to Embodiment 4.
Figure 11B:
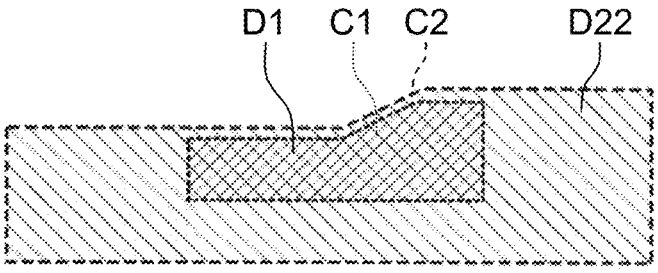
FIG. 11B is a partial enlarged view of FIG. 11A and a view illustrating positions of respective cutoff lines of the lighting device according to Embodiment 1 and the lighting device according to Embodiment 2.
Figure 11C:
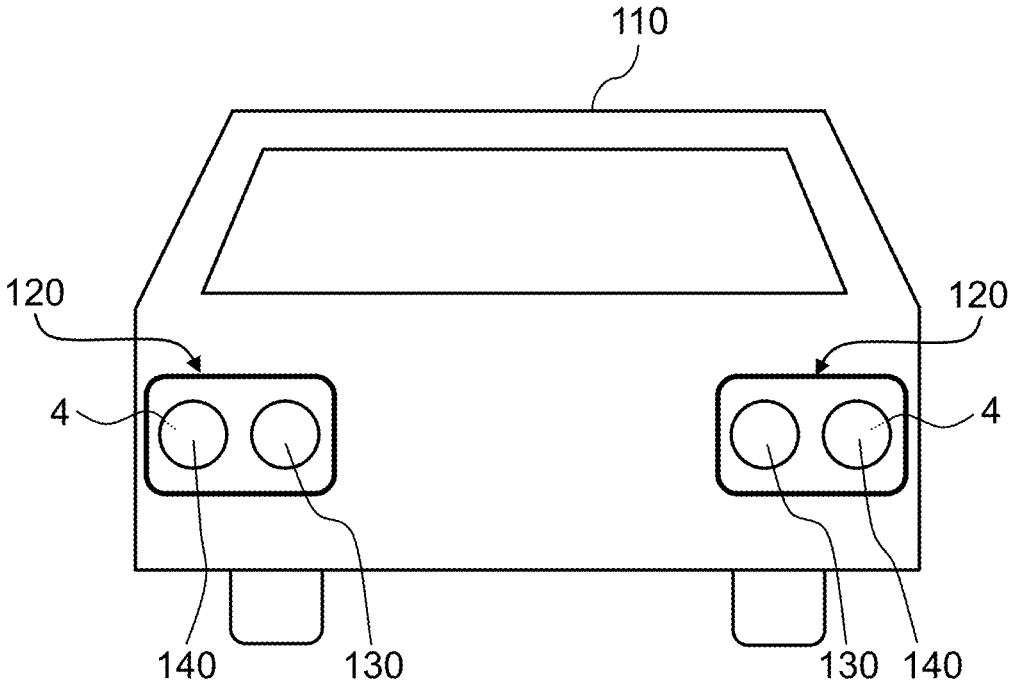
FIG. 11C is a view of a vehicle including the vehicular headlamp according to Embodiment 4 as viewed from front.

Here, FIG. 11C is a view of vehicle 110 including vehicular headlamp 120 according to Embodiment 4 as viewed from front. Vehicular headlamps 120 are attached to right and left sides in the front of vehicle 110 one by one symmetrically in positions lower than a viewpoint of the driver. The vehicular headlamp is configured of high beam 130 (running headlamp) and low beam 140 (passing headlamp). In the embodiment, a case where lighting device 4 is applied to low beam 140 will be described as an example.

FIG. 11A illustrates the light distributions of the lighting devices 1 to 3. Reference numeral D1 indicates the light distribution of lighting device 1 (see FIG. 1A or 1B) according to Embodiment 1, reference numeral D2 indicates the light distribution of lighting device 2 (see FIG. 6) according to Embodiment 2, and reference numeral D3 indicates the light distribution of lighting device 3 (see FIG. 8) according to Embodiment 3, respectively.

As described in Embodiments 1 to 3, lighting devices 1 to 3 include the light emitting element, the first lens that captures and emits the light generated by the light emitting element, and the second lens that captures the light emitted from the first lens and emits the light in a predetermined direction. The first lens includes the first lens entrance where the light generated by the light emitting element enters, the first lens exit that emits the light entered from the first lens entrance through the inside of the first lens, and the plurality of first lens side portion wall surfaces which are provided between the first lens entrance and the first lens exit. The plurality of first lens side portion wall surfaces includes the reflection side surface portion reflecting the light entered the inside of the first lens from the first lens entrance, and the side surface portion configured so that the light having the luminous intensity smaller than the luminous intensity of the light entering the reflection side surface portion enters.

As described in Embodiments 1 to 3, the first lens entrance according to lighting devices 1 to 3 has the recessed shape surrounding the periphery of the light emitting element and includes the first entrance surface that is the bottom surface of the recessed shape and the second entrance surface that is the side surface of the recessed shape. The reflection side surface portion of the plurality of first lens side portion wall surfaces includes the first reflection surface reflecting the light entering the second entrance surface and the second reflection surface reflecting the light entered the first entrance surface and the light reflected by the first reflection surface. The side surface portions of the plurality of first lens side portion wall surfaces are configured to allow the light having the luminous intensity smaller than the luminous intensity of the light entering the first reflection surface and the second reflection surface to enter.

Vehicular headlamp 120 is configured by combining (lighting devices 1 to 3) a plurality of the lighting devices and is configured so that the light beams emitted from the second lens of respective lighting devices (lighting devices 1 to 3) overlap each other.

As described in Embodiment 1, lighting device 1 includes first lens 10 where the step is provided on second reflection surface 13*b*.

As described in Embodiment 2, lighting device 2 includes first lens 10 where the step is provided on second reflection surface 13*b*, and second lens 30 where the plurality of depressions having the spherical shape, the elliptical spherical shape, or the quadrangular pyramid shape are provided in second lens exit 32.

As described in Embodiment 3, lighting device 3 includes second lens 40 where the periodic structure having the wave shape or the conical shape is provided in second lens exit 42.

Here, lighting device 1 corresponds to the first lighting device according to the disclosure, lighting device 2 corresponds to the second lighting device according to the disclosure, and lighting device 3 corresponds to the third lighting device according to the disclosure.

As described in Embodiment 2, light distribution D2 is configured of overhead portion D21 which is concentrically spread and another body portion D22.

FIG. 11B is an enlarged view of the light distributions focusing on only body portion D22 of light distribution D1 and light distribution D2 of FIG. 11A. Light distribution D1 and body portion D22 respectively include cutoff lines C1 and C2.

In light distribution D1 by lighting device 1, it is preferable that cutoff line C1 is formed by the step of second reflection surface 13*b* of first lens 10 and the luminous intensity gradient of cutoff line C1 is more steep than the luminous intensity gradient of the other portion. In light distribution D2 by lighting device 2, it is preferable that cutoff line C2 is formed by the step of second reflection surface 13*b* of first lens 10 and the luminous intensity gradient of cutoff line C2 is more steep than the luminous intensity gradient of the other portion, the range of light distribution D2 is wider than that of lighting device 1, and the maximum luminous intensity is lower than that of lighting device 1.

Here, it is preferable that cutoff line C1 of light distribution D1 and cutoff line C2 of body portion D22 are slightly shifted. In this way, it is possible to gently adjust the luminous intensity gradient of the boundary between light and dark.

Figures 12, 13:
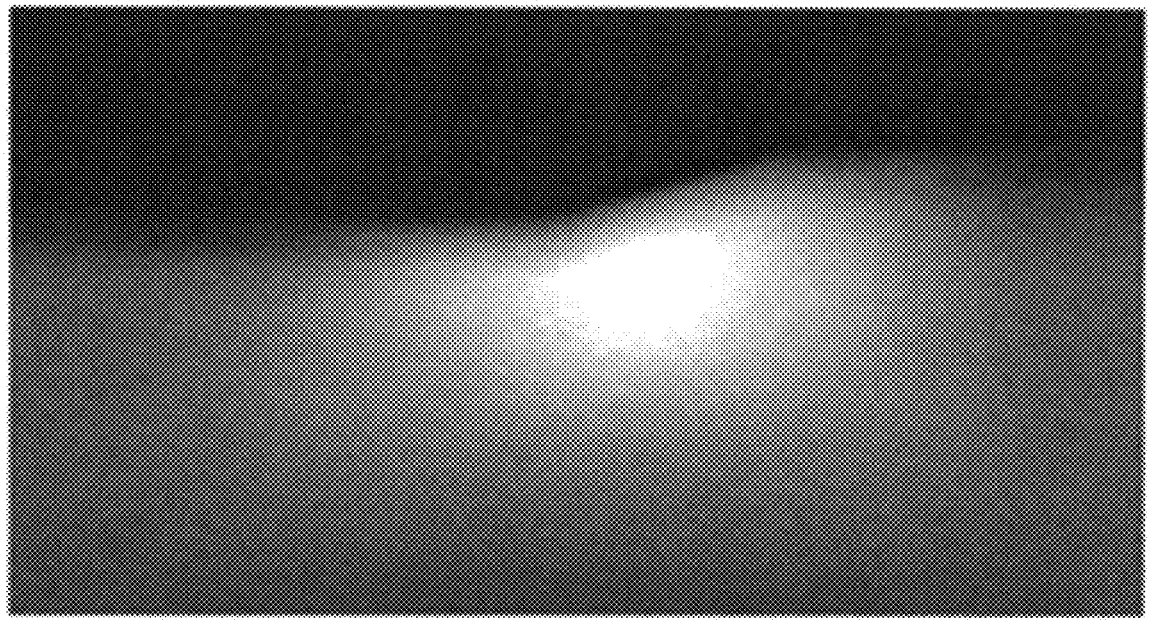
FIG. 12 is a view illustrating the combined light distribution obtained by causing the light distribution of the lighting device according to Embodiment 1 and a part of the light distribution of the lighting device according to Embodiment 2 to overlap each other.
FIG. 13 is a view illustrating a table of an individual luminous intensity and a combined luminous intensity of the lighting devices according to Embodiments 1 to 3 in the vehicular headlamp according to Embodiment 4.

FIG. 12 illustrates the combined light distribution obtained by causing light distribution D1 and body portion D22 to overlap each other. It can be seen that the boundary is formed so that the cutoff line is not conspicuous and the luminous intensity gently changes. In Embodiment 1, in the cutoff line, it is described that it is preferable to make the boundary between light and dark be conspicuous, but if it is too conspicuous, there is a concern that the boundary is erroneously recognized as a contour of an irradiated object, so that it is preferable that the luminous intensity gradient gently changes to a certain degree.

Moreover, in FIG. 11B, an aspect in which cutoff line C1 of light distribution D1 is provided on the inside of cutoff line C2 of body portion D22 is described, but the embodiment is not limited to the aspect, an aspect in which cutoff line C1 of light distribution D1 is provided on an outside of cutoff line C2 of body portion D22 may be provided.

In addition, instead of the aspect in which cutoff lines C1 and C2 are shifted, an undulation of a deviation amount from a curved surface having a size of 1 micron or more and 100 microns or less is formed on a curved surface of projected second lens exit 22 of second lens 20 of any one of the lighting devices of Embodiment 1 and 2, so that similar to the above description, the boundary in the cutoff line can be adjusted to the luminous intensity gradient that is natural and not steep. If the undulation of the deviation amount from the curved surface is less than 1 micron, the effect is small and if the undulation is larger than 100 micron, the whole light distribution shape is lost.

FIG. 13 is a view illustrating an example of conditions of an individual unit peak luminous intensity of lighting devices 1 to 3, a combined luminous intensity of three lighting devices 1 to 3, and a light flux of a light source (output of the light emitting element) according to Embodiments 1 to 3. The first and second lenses of lighting devices 1 to 3 are designed so that a peak luminous intensity is set to be higher in order of lighting device 1 of Embodiment 1, lighting device 2 of Embodiment 2, and lighting device 3 of Embodiment 3.

According to the embodiment, it is possible to obtain the vehicular headlamp that irradiates light over a wide range while securing the maximum luminous intensity required for regulations. In this case, in the boundary of the region in which the light beams of respective lighting devices 1 to 3 overlap each other, the luminous intensity gradient gently changes, so that the boundary between light and dark is inconspicuous. Therefore, the streak unevenness does not occur when the vehicular headlamp irradiates the road surface and it is possible to prevent visibility of the driver of the vehicle from being hindered.

Figure 14:
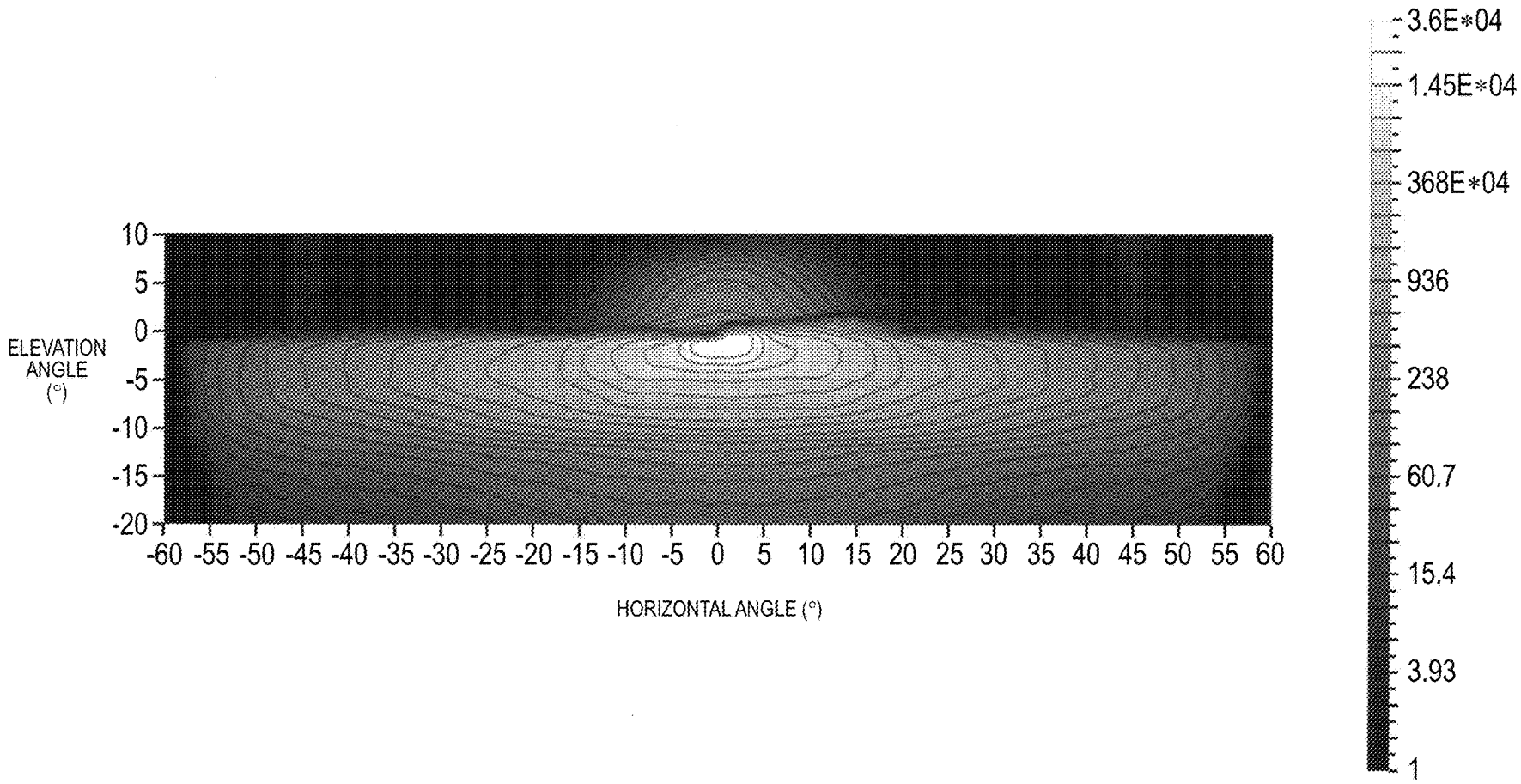
FIG. 14 is a view illustrating a simulation result of the light distribution of the vehicular headlamp according to Embodiment 4.
Figure 15:
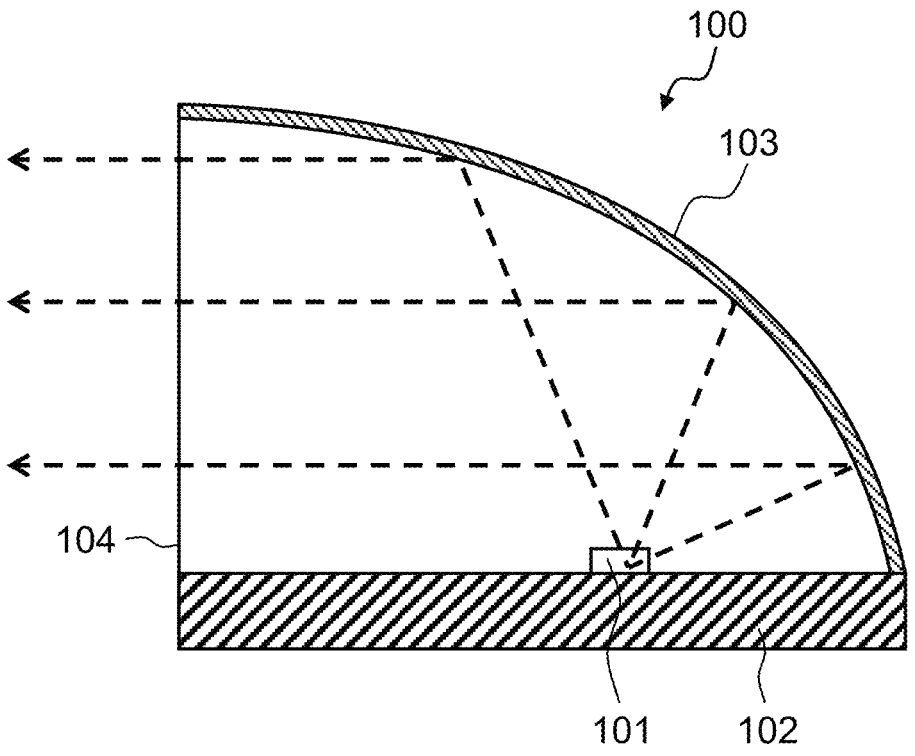
FIG. 15 Prior Art
FIG. 15 is a sectional view of the lighting device of the related art.

FIG. 14 illustrates a simulation result of the light distribution of the vehicular headlamp according to Embodiment 4. A horizontal axis indicates a horizontal angle, a vertical axis indicates an elevation angle, and a contour line indicates the luminous intensity. As described above, the light distribution is provided so that the luminous intensity at the center is strong and the luminous intensity gradient gently changes from right and left, and downward therefrom. An upper center is the light distribution of an overhead portion with weak light of substantially several hundred candela.

Moreover, Embodiment 4 is an application example to the passing headlamp (low beam 140 illustrated in FIG. 11C), but the disclosure is not limited to the application example. Since it is possible to form any light distribution by overlapping light beams other than the passing headlamp, the disclosure can be applied to the running headlamp (high beam 130 illustrated in FIG. 11C), a daytime running lamp, or the like.

In addition, as illustrated in FIG. 6 and the like, second lens exit 32 of second lens 30 of lighting device 2 according to Embodiment 2 has an aspect in which depression 32*a* having the spherical shape is formed, but the lighting device according to the disclosure is not limited to the aspect. For example, instead of depression 32*a* having the spherical shape, even if a depression having an elliptical spherical shape, a depression having a quarter spherical shape, a depression having the quadrangular pyramid shape, or the like is provided, the same effects can be obtained. The shape of the overhead portion changes corresponding to the shape of the depression.

Furthermore, as illustrated in FIG. 8 and the like, second lens exit 42 of second lens 40 of lighting device 3 according to Embodiment 3 has an aspect in which the unevenness having the wave shape is provided on the surface, but the lighting device according to the disclosure is not limited to the aspect. For example, instead of the unevenness having the wave shape, even if an unevenness having a conical shape, an unevenness having a triangular pyramid shape, or the like is provided, the same effects can be obtained.

In addition, in Embodiment 4, the arrangement of each of lighting devices 1 to 3 according to Embodiments 1 to 3 is optional. For example, they may be arranged in a line in the horizontal direction (width direction of the vehicle), may be arranged in a line in the height direction, or may be arranged in a line in a diagonal direction. Furthermore, they may be arranged diagonally from the front side to the depth side in the depth direction (forward and backward direction of the vehicle). Even if the number of the lighting devices is increased and the lighting devices are arranged in a circle, the light distribution to be target can be formed without being shifted.

INDUSTRIAL APPLICABILITY

The lighting device according to the present disclosure is useful for a lighting device configuring a vehicular headlamp.

REFERENCE MARKS IN THE DRAWINGS

1, 2, 3, 4, 100 LIGHTING DEVICE
10, 50 FIRST LENS
11 FIRST LENS ENTRANCE
11*a* FIRST ENTRANCE SURFACE
11*b* SECOND ENTRANCE SURFACE
12, 52 FIRST LENS EXIT
13 FIRST LENS SIDE PORTION WALL SURFACE
13*a* FIRST REFLECTION SURFACE (REFLECTION SIDE SURFACE PORTION)
13*b* SECOND REFLECTION SURFACE (REFLECTION SIDE SURFACE PORTION)
13*c*, 13*d*, 13*e*, 53*c*, 53*d*, 53*e* SIDE SURFACE PORTION
20, 30, 40 SECOND LENS
21, 31, 41 SECOND LENS ENTRANCE
22, 32, 42 SECOND LENS EXIT
23, 33, 43 SECOND LENS SIDE PORTION WALL SURFACE
24 LIGHT SHIELDING MEMBER
53*a*, 53*b* REFLECTION SURFACE (REFLECTION SIDE SURFACE PORTION)
110 VEHICLE
120 VEHICULAR HEADLAMP
130 HIGH BEAM
140 LOW BEAM
L LIGHT EMITTING ELEMENT

The invention claimed is:

1. A lighting device comprising:
a light emitting element;
a first lens that captures and emits light generated by the light emitting element; and
a second lens that captures light emitted from the first lens and emits the light in a predetermined direction,
wherein the first lens includes
a first lens entrance through which the light generated by the light emitting element enters,
a first lens exit that emits the light entered from the first lens entrance and transmitted through an inside of the first lens, and
a plurality of first lens side portion wall surfaces that are provided between the first lens entrance and the first lens exit, and
wherein the plurality of first lens side portion wall surfaces include
a reflection side surface portion that reflects the light entered the inside of the first lens from the first lens entrance, and
a side surface portion that is configured to allow light having a luminous intensity smaller than a luminous intensity of light entering the reflection side surface portion to enter, and
wherein the side surface portion is formed to be away from a horizontal line passing through a center of the light emitting element from the first lens entrance toward the first lens exit.

2. The lighting device of claim 1,
wherein the first lens entrance has a recessed shape surrounding a periphery of the light emitting element, and includes
a first entrance surface that is a bottom surface of the recessed shape, and
a second entrance surface that is a side surface of the recessed shape,
wherein the reflection side surface portion of the plurality of first lens side portion wall surfaces includes
a first reflection surface that reflects the light entered the second entrance surface, and
a second reflection surface that reflects the light entered the first entrance surface and the light reflected by the first reflection surface, and
wherein the side surface portion of the plurality of first lens side portion wall surfaces is configured to allow light having a luminous intensity smaller than a luminous intensity of the light entering the first reflection surface and the second reflection surface to enter.

3. The lighting device of claim 2, wherein the second reflection surface of the first lens is provided with a step.

4. The lighting device of claim 2, wherein a second lens exit included in the second lens is provided with a plurality of depressions having a spherical shape, an elliptical spherical shape, or a quadrangular pyramid shape.

5. The lighting device of claim 2, wherein a second lens exit included in the second lens is provided with a periodic structure having a wave shape or a conical shape.

6. A vehicular headlamp configured by combining a combination of a plurality of the lighting devices of claim 2, so that light emitted from the second lens of the respective lighting devices overlap each other.

7. The lighting device of claim 1, wherein a second lens exit included in the second lens includes a curved surface having a projection shape toward a side opposite to the light emitting element, and an undulation of a deviation amount from the curved surface having a size of 1 micron or more and 100 microns or less is formed on the curved surface.

8. The lighting device of claim 1, wherein the second lens includes a second lens side portion wall surface provided between a second lens entrance and a second lens exit included in the second lens, and wherein a light shielding member for shielding light toward the second lens side portion wall surface is provided on an outer edge of the second lens entrance.

9. The lighting device of claim 1, wherein the second lens includes a second lens side portion wall surface provided between a second lens entrance and a second lens exit included in the second lens, and wherein an uneven structure for diffusing light is formed on the second lens side portion wall surface.

10. A vehicular headlamp including a plurality of lighting devices, the plurality of lighting devices including at least first, second and third lighting devices, each comprising:

a light emitting element;

a first lens that captures and emits light generated by the light emitting element; and a second lens that captures light emitted from the first lens and emits the light in a predetermined direction, wherein the first lens includes a first lens entrance through which the light generated by the light emitting element enters, a first lens exit that emits the light entered from the first lens entrance and transmitted through an inside of the first lens, and a plurality of first lens side portion wall surfaces that are provided between the first lens entrance and the first lens exit, and wherein the plurality of first lens side portion wall surfaces include a reflection side surface portion that reflects the light entered the inside of the first lens from the first lens entrance, and a side surface portion that is configured to allow light having a luminous intensity smaller than a luminous intensity of light entering the reflection side surface portion to enter wherein the first lens entrance has a recessed shape surrounding a periphery of the light emitting element, and includes a first entrance surface that is a bottom surface of the recessed shape, and a second entrance surface that is a side surface of the recessed shape, wherein the reflection side surface portion of the plurality of first lens side portion wall surfaces includes a first reflection surface that reflects the light entered the second entrance surface, and a second reflection surface that reflects the light entered the first entrance surface and the light reflected by the first reflection surface, and wherein the side surface portion of the plurality of first lens side portion wall surfaces is configured to allow light having a luminous intensity smaller than a luminous intensity of the light entering the first reflection surface and the second reflection surface to enter, wherein light emitted from the second lens of each of the respective lighting devices overlaps each other, wherein in the first and second lighting devices:

the first lens entrance has a recessed shaped surrounding a periphery of the light emitting element, and includes a first entrance surface that is a bottom surface of the recessed shape, and a second entrance surface that is a side surface of the recessed shape, the reflection side surface portion of the plurality of first lens side portion wall surfaces includes a first reflection surface that reflects the light entered the second entrance surface, and a second reflection surface that reflects the light entered the first entrance surface and the light reflected by the first reflection surface, and the side surface portion of the plurality of first lens side portion wall surfaces is configured to allow light having a luminous intensity smaller than a luminous intensity of the light entering the first reflection surface and the second reflection surface to enter, wherein the first lighting device has the first lens provided with a step on the second reflection surface, wherein the second lighting device has the first lens provided with a step on the second reflection surface, and the second lens provided with a plurality of depressions having a spherical shape, or an elliptical spherical shape, or a quadrangular pyramid shape on a second lens exit, and wherein the third lighting device has the second lens provided with a periodic structure having a wave shape or a conical shape on a second lens exit.

11. The vehicular headlamp of claim 10, wherein in light distribution by the first lighting device, a cutoff line is formed by the step of the second reflection surface of the first lens, and a luminous intensity gradient of the cutoff line is more steep than luminous intensity gradients of other portions.

12. The vehicular headlamp of claim 10, wherein in light distribution by the second lighting device, a cutoff line is formed by the step of the second reflection surface of the first lens, and a luminous intensity gradient of the cutoff line is more steep than luminous intensity gradients of other portions, and a range of the light distribution is wider than that of the first lighting device, and a maximum luminous intensity is lower than that of the first lighting device.

13. The vehicular headlamp of claim 10, wherein light distribution by the second lighting device includes a light distribution portion formed by a depression of the second lens exit, and luminous intensity of the light distribution portion is 10 candela or more and 625 candela or less.

14. The vehicular headlamp of claim 10, wherein light distribution by the third lighting device is the light distribution in a range wider than a range of −30° to +30° in a horizontal direction and in a range wider than a range of −10° to 0° in a height direction.

15. The vehicular headlamp of claim 10, wherein in light distribution by the first lighting device and the second lighting device, cutoff lines are respectively formed by the step of the second reflection surface of the first lens, and a luminous intensity gradient of the cutoff line is more steep than luminous intensity gradients of other portions, and wherein the cutoff line of the light distribution of the first lighting device and the cutoff line of the second lighting device are deviated from each other.

* * * * *